US006930571B2

(12) United States Patent
Tada et al.

(10) Patent No.: US 6,930,571 B2
(45) Date of Patent: Aug. 16, 2005

(54) DIELECTRIC FILTER, DIELECTRIC DUPLEXER, AND COMMUNICATION APPARATUS

(75) Inventors: Hitoshi Tada, Moriyama (JP); Hideyuki Kato, Moriyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/422,987

(22) Filed: Apr. 25, 2003

(65) Prior Publication Data

US 2003/0210112 A1 Nov. 13, 2003

(30) Foreign Application Priority Data

May 10, 2002 (JP) ..... 2002-135498

(51) Int. Cl.[7] ..... H01P 1/202
(52) U.S. Cl. ..... 333/206; 333/219.1; 333/222
(58) Field of Search ..... 333/206, 207, 333/81 A, 219.1, 222, 223, 234, 235

(56) References Cited

U.S. PATENT DOCUMENTS 4,464,640 A * 8/1984 Nishikawa et al. ..... 333/202
4,808,951 A * 2/1989 Yamato et al. ..... 333/202
5,055,808 A * 10/1991 Walker et al. ..... 333/207
5,379,011 A * 1/1995 Sokola et al. ..... 333/206
6,707,685 B2 * 3/2004 Kabumoto et al. ..... 361/794

FOREIGN PATENT DOCUMENTS

JP 2000-223908 8/2000

* cited by examiner

*Primary Examiner*—Timothy P. Callahan
*Assistant Examiner*—An T. Luu
(74) *Attorney, Agent, or Firm*—Dickstein, Shapiro, Morin & Oshinsky, LLP

(57) ABSTRACT

A dielectric filter includes a dielectric block having a plurality of through holes; an outer conductor provided on an outer surface of the dielectric block; and inner conductors provided on inner surfaces of the plurality of through holes. The dielectric filter also includes a first dielectric provided between the respective inner conductors and the outer conductor; and at least one second dielectric provided between the inner conductors of two adjacent through holes. The temperature coefficient of the resonant frequency of the first dielectric is different from that of the second dielectric. If inductive coupling between the adjacent resonators generates an attenuation pole at a frequency higher than a pass band, the temperature coefficient of the resonant frequency of the first dielectrics is set to a predetermined positive value, and the temperature coefficient of the resonant frequency of the second dielectric is set to a predetermined negative value.

19 Claims, 11 Drawing Sheets

—— : WAVEFORM AT ROOM TEMPERATURE

------ : WAVEFORM AT HIGH TEMPERATURE

TC OF RESONATOR PART: POSITIVE
TC OF COUPLING PART: NEGATIVE

—— ; WAVEFORM AT ROOM TEMPERATURE

—— ; WAVEFORM AT HIGH TEMPERATURE

TC OF RESONATOR PART: NEGATIVE
TC OF COUPLING PART: POSITIVE

———: WAVEFORM AT ROOM TEMPERATURE

- - - - - - - : WAVEFORM AT HIGH TEMPERATURE TC: 0

———: WAVEFORM AT HIGH TEMPERATURE TC: POSITIVE

DIELECTRIC FILTER, DIELECTRIC DUPLEXER, AND COMMUNICATION APPARATUS

BACKGROUND OF THE INVENTION

1. Field of the Invention

The present invention relates to dielectric filters and dielectric duplexers provided with dielectrics on resonators and to communication apparatuses provided with the dielectric filters or the dielectric duplexers.

2. Description of the Related Art

In general, for example, in dielectric filters provided with a plurality of dielectric resonators on dielectric blocks, unloaded Q factor (Qo) of the resonator decreases as the ambient temperature increases, and Qo increases as the ambient temperature decreases. This is due to the temperature dependency of the conducting loss of an inner conductor and an outer conductor provided on dielectric blocks. For example, a ten-degree increase in temperature causes an approximately two percent decrease in the conductivity of silver and copper. This decrease in the conductivity of electrodes results in a decrease in Qo. Thus, the insertion loss of dielectric filters increases as the temperature increases.

Also, in general, the insertion loss of band pass filters increases in a range from a pass band to an attenuation band at lower frequencies and a range from the pass band to an attenuation band at higher frequencies.

The frequency characteristics of the insertion loss (which are the transmission characteristics) required for the band pass filter are represented by a point determined by a frequency at which the insertion loss is a predetermined maximum value and by the predetermined maximum insertion loss (hereinafter, referred to as a critical point in a pass band).

The transmission characteristics are, however, shifted toward higher frequencies or lower frequencies in accordance with a change in the temperature, due to the temperature dependency of a resonance frequency determined by the dielectric constant of the dielectric.

As described above, the transmission characteristics of dielectric filters vary with temperature, under the influence of the temperature dependency of the conductivity of the electrodes and the temperature dependency of the dielectric constant of the dielectrics.

A dielectric filter and the like that achieve stable passband characteristics as much as possible over a wide temperature range is disclosed in Japanese Unexamined Patent Application Publication No. 2000-223908.

A dielectric duplexer disclosed in Japanese Unexamined Patent Application Publication No. 2000-223908 includes a dielectric filter having a lower-frequency pass band and a dielectric filter having a higher-frequency pass band. The dielectric filter having the lower-frequency pass band uses a dielectric with a positive temperature coefficient of the resonant frequency and the dielectric filter having the higher-frequency pass band uses a dielectric with a negative temperature coefficient of the resonant frequency. Thus, the increase in the insertion loss due to the increase in the temperature is suppressed. The insertion loss in the two dielectric filters for the higher frequencies and the lower frequencies are prevented from exceeding the value at the predetermined critical point in the pass band.

The transmission characteristics required for band pass filters are, however, also represented by a point determined by a frequency at which the attenuation is a predetermined minimum value and by the predetermined minimum attenuation (hereinafter, referred to as a critical point in an attenuation band), as well as the critical point in the pass band.

FIG. 11 shows the transmission characteristics of a known dielectric filter. Here, a point A represents a critical point in the pass band, and a point B represents a critical point in the attenuation band. If the temperature coefficient of the resonant frequency Tc of the dielectric is zero, the insertion loss increases by conducting loss of an inner conductor and an outer conductor at a high temperature. If the temperature coefficient of the resonant frequency Tc of the dielectric is a predetermined positive value, the entire pass band and an attenuation pole frequency are shifted towards higher frequencies at the high temperature.

Although determining the temperature coefficient of the resonant frequency of the dielectric suppresses the increase in the insertion loss near the critical point A in the pass band, the attenuation near the critical point B in the attenuation band decreases. This causes a problem when not only the insertion loss in the pass band but also the attenuation in the attenuation band is strictly determined.

SUMMARY OF THE INVENTION

Accordingly, it is an object of the present invention to provide a dielectric filter and a dielectric duplexer that suppress an increase in insertion loss in a pass band and a decrease in attenuation in an attenuation band due to an increase in temperature and to provide a communication apparatus provided with the dielectric filter or the dielectric duplexer.

A dielectric filter includes a dielectric block being substantially rectangular parallelepiped, the dielectric block having a plurality of through holes that extend from a first surface to an opposing second surface of the dielectric block; an outer conductor provided on an outer surface of the dielectric block; inner conductors provided in inner surfaces of the plurality of through holes; a first dielectric provided between the respective inner conductors and the outer conductor; and at least one second dielectric provided between the inner conductors of two adjacent through holes. The temperature coefficient of the resonant frequency of the first dielectrics is different from the temperature coefficient of the resonant frequency of the second dielectric.

In the dielectric filter with the arrangement described above, resonator parts formed by the first dielectric provided between respective inner conductors and the outer conductor influence the frequency characteristics of the pass band. The second dielectric between adjacent resonators (coupling part) influences the frequency characteristics of the attenuation pole. Thus, the temperature coefficient of the resonant frequency of the pass band and the temperature coefficient of the resonant frequency of the attenuation band are substantially independently determined.

In the dielectric filter according to the present invention, a stray capacitance may be generated between at least one end of each of the inner conductors and the outer conductor so that resonators formed by the adjacent inner conductors are inductively coupled. Preferably, the temperature coefficient of the resonant frequency of the first dielectrics is positive and the temperature coefficient of the resonant frequency of the second dielectric is negative.

Accordingly, the inductive coupling between the adjacent resonators generates an attenuation pole at a higher frequency than the pass band. Setting the temperature coefficient of the resonant frequency of the first dielectrics to positive causes the pass band to be shifted toward higher frequencies in accordance with the increase in temperature. Setting the temperature coefficient of the resonant frequency of the second dielectric to negative causes the attenuation pole frequency to be shifted toward lower frequencies in accordance with the increase in temperature. Thus, even at high temperatures, the insertion loss in the pass band is not above the value at the critical point in the pass band, and the attenuation in the attenuation band is not below the value at the critical point in the attenuation band.

In the dielectric filter according to the present invention, preferably, at least one end of each of the inner conductors may not be connected to the outer conductor so that resonators formed by the adjacent inner conductors are capacitively coupled. Preferably, the temperature coefficient of the resonant frequency of the first dielectrics is negative and the temperature coefficient of the resonant frequency of the second dielectric is positive.

Accordingly, the capacitive coupling between the adjacent resonators generates an attenuation pole at a lower frequency than the pass band. Setting the temperature coefficient of the resonant frequency of the first dielectric to negative causes the pass band to be shifted toward lower frequencies in accordance with the increase in temperature. Setting the temperature coefficient of the resonant frequency of the second dielectric to positive causes the attenuation pole frequency to be shifted toward higher frequencies in accordance with the increase in temperature. Thus, even at high temperatures, the insertion loss in the pass band is not above the value at the critical point in the pass band, and the attenuation in the attenuation band is not below the value at the critical point in the attenuation band.

A dielectric duplexer according to the present invention includes the dielectric filter exhibiting an attenuation pole at a higher frequency and the dielectric filter exhibiting an attenuation pole at a lower frequency. The dielectric filter exhibiting the attenuation pole at the higher frequency has a lower-frequency pass band. The dielectric filter exhibiting the attenuation pole at the lower frequency has a higher-frequency pass band.

A communication apparatus according to the present invention includes the dielectric filter or the dielectric duplexer provided, for example, in an RF circuit. Thus, a predetermined signal processing function of the RF circuit can be maintained over a wide temperature range.

DESCRIPTION OF THE PREFERRED EMBODIMENTS

The structure of a dielectric filter according to a first embodiment of the present invention will be described with reference to FIGS. 1A, 1B, 1C and 1D, FIGS. 2A and 2B, FIG. 3, and FIG. 4.

Figure 1A:
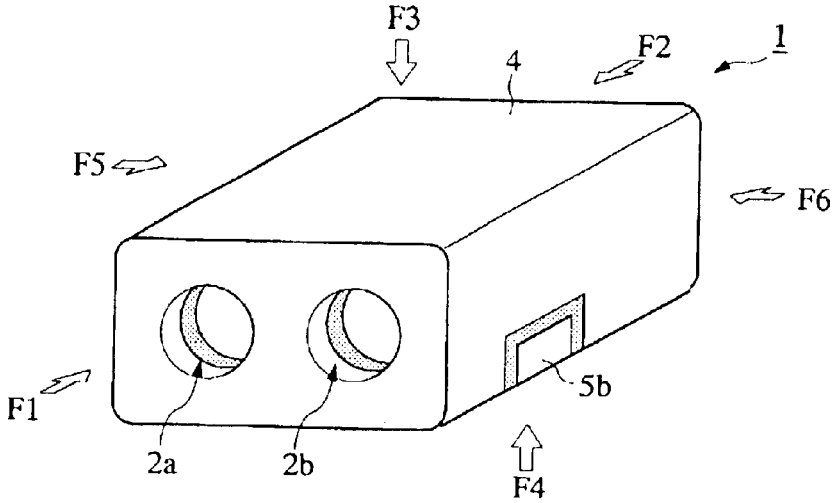
FIG. 1A is an external perspective view of the dielectric filter according to a first embodiment of the present invention.
Figure 1B:
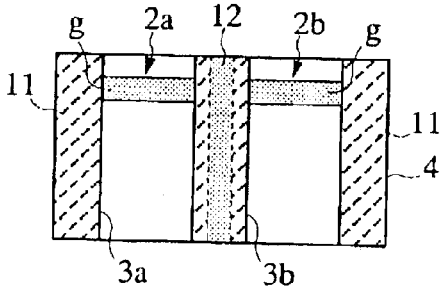
FIG. 1B is a cross-sectional view of the dielectric filter.
Figure 1C:
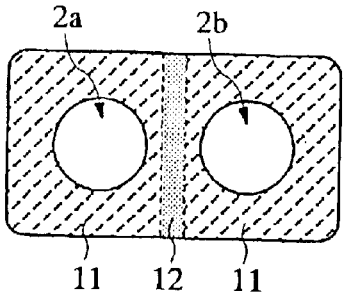
FIG. 1C is a longitudinal sectional view of the dielectric filter.
Figure 1D:
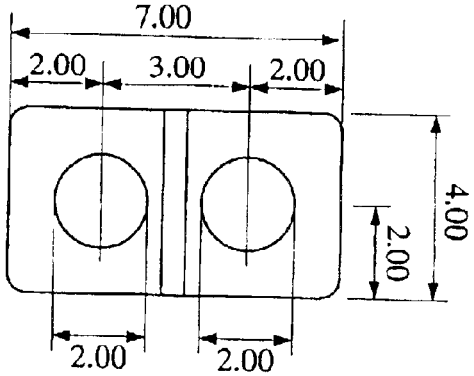
FIG. 1D shows the specific dimensions of each unit of the dielectric filter.

FIG. 1A is an external perspective view of the dielectric filter, FIG. 1B is a cross-sectional view of the dielectric filter, and FIG. 1C is a longitudinal sectional view of the dielectric filter. FIG. 1D shows the specific dimensions of each unit of the dielectric filter. The dimensions are in millimeters [mm] and are merely exemplary.

A dielectric block 1 is preferably a substantially rectangular parallelepiped. The dielectric block 1 has through holes 2*a* and 2*b* that extend from a first surface F1 to an opposing second surface F2 and that are substantially parallel to a third surface F3 and an opposing fourth surface F4 that are perpendicular to the first surface F1 and the second surface F2. Inner conductors 3*a* and 3*b* are provided on inner surfaces of the through holes 2*a* and 2*b*, respectively. Thus, the through holes 2*a* and 2*b* function as resonator holes. An outer conductor 4 is provided over six outer surfaces of the dielectric block 1. A nonconductive portion g, in which an inner conductor is not provided, is arranged near the end at the first surface F1 side of each of the inner conductors 3*a* and 3*b*, thus causing a stray capacitance in the nonconductive portion g. An input-output electrode 5*b* is provided on a portion from the fourth surface F4 to the sixth surface F6 of the dielectric block 1, thus causing the capacitance between the input-output electrode 5*b* and the vicinity of the open end of the inner conductor 3*b*. Another input-output electrode (not shown) is provided on a portion from the fourth surface F4 to the fifth surface F5 of the dielectric block 1, thus causing the capacitance between the input-output electrode and the vicinity of the open end of the inner conductor 3*a*.

As shown in FIGS. 1B and 1C, in the dielectric filter, the dielectric block 1 includes a first dielectric 11 and a second dielectric 12. The first dielectric 1 is arranged between the inner conductor 3*a* and the outer conductor 4 and between the inner conductor 3*b* and the outer conductor 4, respectively. The second dielectric 12 is arranged between the inner conductor 3*a* and the inner conductor 3*b*. The first dielectric 11 exhibits a positive temperature coefficient of the resonant frequency, and the second dielectric 12 exhibits a negative temperature coefficient of the resonant frequency. The temperature dependency of the resonance frequency is determined from the temperature coefficient of the dielectric constant of a dielectric portion forming a resonator (in this case, by the temperature coefficient of the dielectric constant of the first dielectrics 11). The temperature characteristics of dielectric materials are, however, generally determined by measuring the resonance frequency of a dielectric resonator. Thus, the temperature characteristics of the dielectric are expressed by a temperature coefficient of the resonant frequency.

Each part of the dielectric block 1 preferably has the following dimensions:

Overall outer dimensions: 4×7×8 (axial length) mm

Inside diameter of through holes (resonator holes): ø2.0 mm

Pitch between resonator holes: 3.0 mm

Dimensions of the first dielectric: 3.25 mm (both have the same size)

Dimensions of the second dielectric: 0.5 mm

Figure 2A:
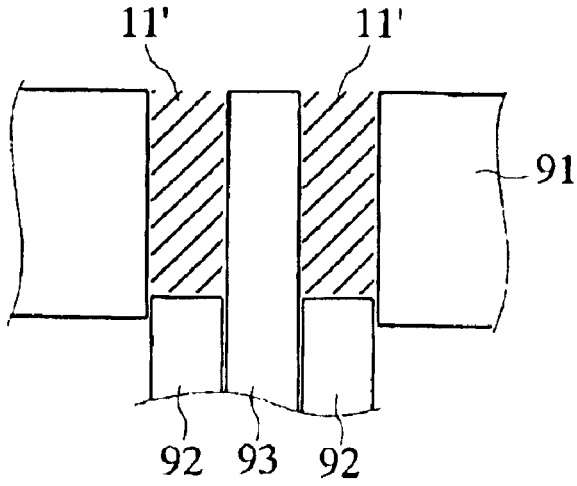
FIGS. 2A and 2B show part of a manufacturing process of the dielectric filter.
Figure 2B:
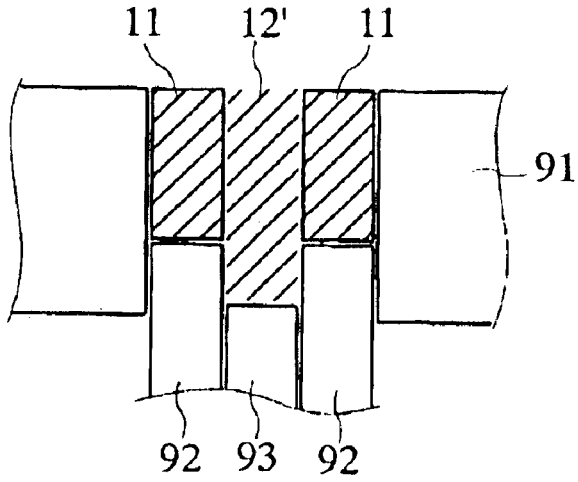

FIGS. 2A and 2B show a method of forming the dielectric block 1 including the above two types of dielectrics.

A die opening 91 is provided with punches 92 and 93. Only the punch 93, which is sandwiched between the punches 92, is projected, and dielectric material 11' for the first dielectric 11 is filled into the die opening. Then, the punch 92 is pushed up to compress the dielectric material 11'. Accordingly, the first dielectric 11 is formed. Then, the punch 93 is lowered, and dielectric material 12' for the second dielectric 12 is filled into the resultant space. Then, the punch 93 is pushed up to compress the dielectric material 12'. Accordingly, the second dielectric 12 is formed. Consequently, the integrated dielectric block 1 of the two types of dielectrics is formed.

Die parts for forming the through holes 2*a* and 2*b* are not shown in FIGS. 2A and 2B. Basically, dies are disposed in advance in portions where the through holes 2*a* and 2*b* are formed, and after filling and compressing dielectric materials, the dies are pulled out, as in a known molding method.

Figure 3:
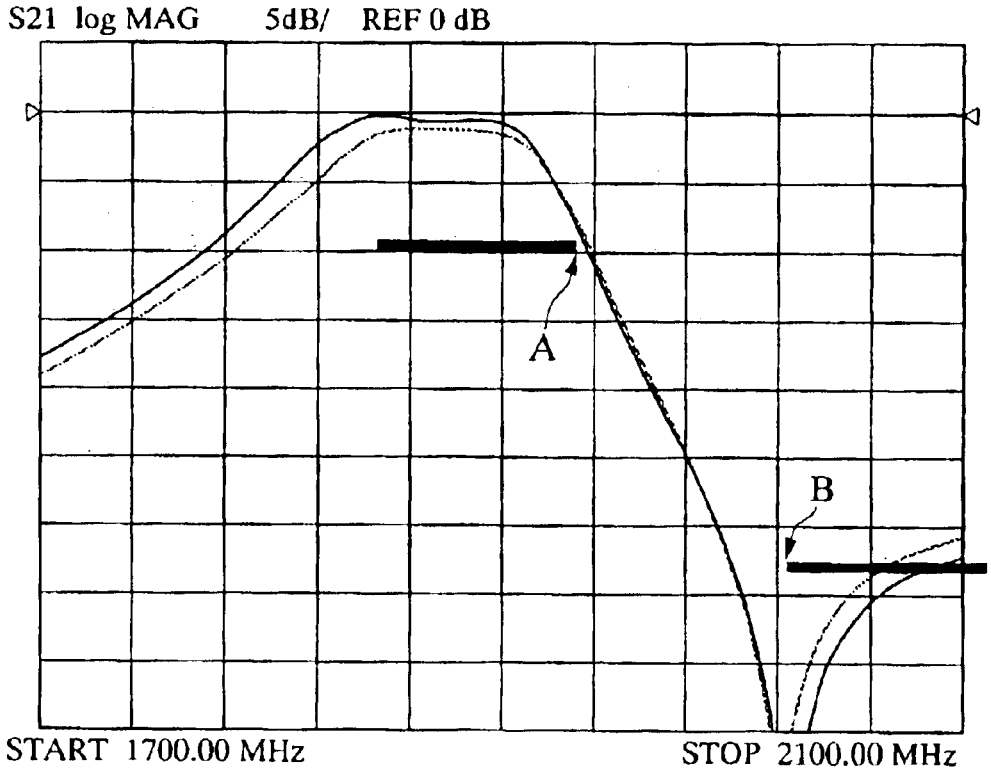
FIG. 3 is a graph showing the transmission characteristics of the dielectric filter.

FIG. 3 shows the transmission characteristics of the dielectric filter according to the first embodiment when the dimensions of each part of the dielectric filter is set as shown in FIG. 1D. The dielectric filter is used in a temperature range between −35° C. and 85° C. In FIG. 3, the solid lines show the transmission characteristics at room temperature (25° C.), and the broken lines show the transmission characteristics at a high temperature (85° C.). In FIG. 3, a point A represents a critical point in the pass band, and a point B represents a critical point in the attenuation band.

As shown in FIGS. 1A to 1C, the stray capacitance between one end of the inner conductor 3*a* and the outer conductor 4 and between one end of the inner conductor 3*b* and the outer conductor 4 causes inductive coupling between the resonators. Thus, an attenuation pole is generated at a higher frequency than the pass band. Although, at the high temperature, the insertion loss in the pass band increases due to the conducting loss of the inner conductors and the outer conductor, setting the temperature coefficient of the resonant frequency of the first dielectric 11 that influences frequencies of the pass band to be positive and setting the temperature coefficient of the resonant frequency of the second dielectric 12 that influences the attenuation pole frequency to be negative cause the frequencies of the pass band to be shifted toward higher frequencies and the attenuation pole to be shifted toward lower frequencies at the high temperature. Thus, the insertion loss in the pass band is not above the value at the critical point A, regardless of whether at room temperature or at a higher temperature. Also, the attenuation in the attenuation band is not below the value at the critical point B, regardless of whether at room temperature or at a higher temperature. Consequently, the insertion loss in the pass band does not exceed a predetermined value, and a predetermined attenuation is assured in the attenuation band.

Figure 4:
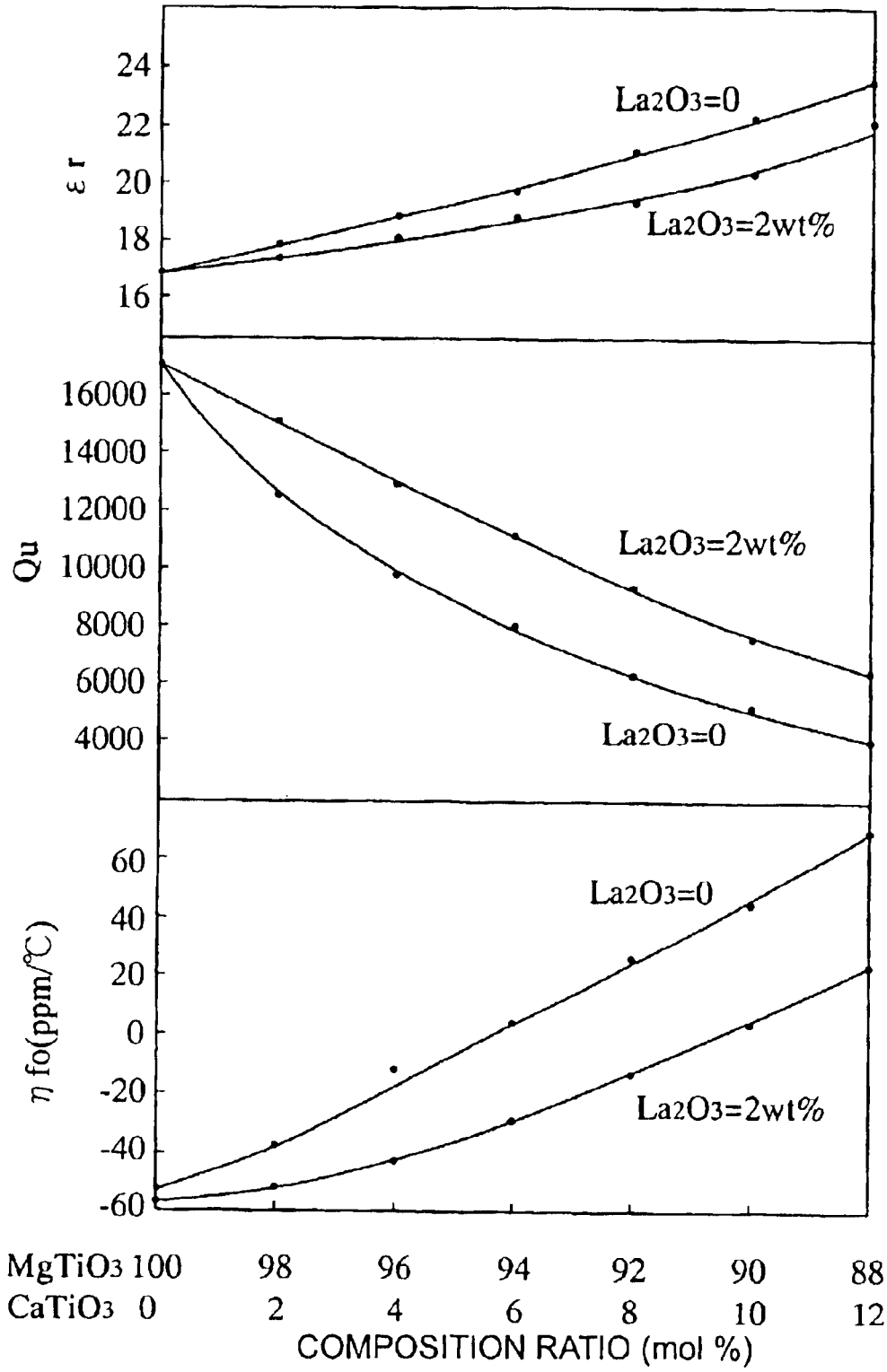
FIG. 4 is a graph showing the characteristics of dielectric materials used for the dielectric filter.

FIG. 4 shows the characteristics of dielectric materials, when $La_2O_3$ is not added and when $La_2O_3$ is added by 2 wt %, with respect to the composition ratio of $MgTiO_3$ and $CaTiO_3$. Here, $\epsilon r$ represents a relative dielectric constant of a dielectric, Qu represents Q particular to dielectric materials, and $\eta fo$ represents a temperature coefficient of the resonant frequency. Accordingly, the temperature coefficient of the resonant frequency of the dielectric can be appropriately determined in accordance with the composition ratio of $MgTiO_3$, $CaTiO_3$, and $La_2O_3$.

In the example shown in FIG. 3, the first dielectric 11 is a composition of $MgTiO_3$ and $CaTiO_3$ in which the ratio of $MgTiO_3$ to $CaTiO_3$ is 92 to 8, and the temperature coefficient of the resonant frequency of the first dielectrics 11 is 20 ppm/° C. The second dielectric 12 is a composition of $MgTiO_3$ and $CaTiO_3$ in which the ratio of $MgTiO_3$ to $CaTiO_3$ is 98 to 2, and the temperature coefficient of the resonant frequency of the second dielectric 12 is −40 ppm° C.

For the materials of the first dielectric 11 and the second dielectric 12, $MgTiO_3$—$(CaLa)TiO_3$ ceramics to which an additive $La_2O_3$ is added may be used.

Although the second dielectric 12 is provided to cover the entire width of the dielectric block 1 so that the through holes 2*a* and 2*b* are completely separated from each other in the example shown in FIGS. 1A to 1C, the width of the second dielectric 12 is not necessarily equal to the entire width of the dielectric block 1. The second dielectric 12 may be disposed between two adjacent through holes. Changing the ratio of the sizes between the first dielectric 11 and the second dielectric 12 allows the adjustment of the transmission characteristics. For example, a relative increase in the size of the first dielectric 11 causes a relative increase in the shift amount of the pass band due to the temperature change. In contrast, a relative increase in the size of the second dielectric 12 causes a relative increase in the shift amount of the attenuation pole frequency due to the temperature change. The description described above is also applicable to the following embodiments.

A dielectric filter according to a second embodiment of the present invention will now be described with reference to FIGS. 5A, 5B, and 5C and FIG. 6.

Figure 5A:
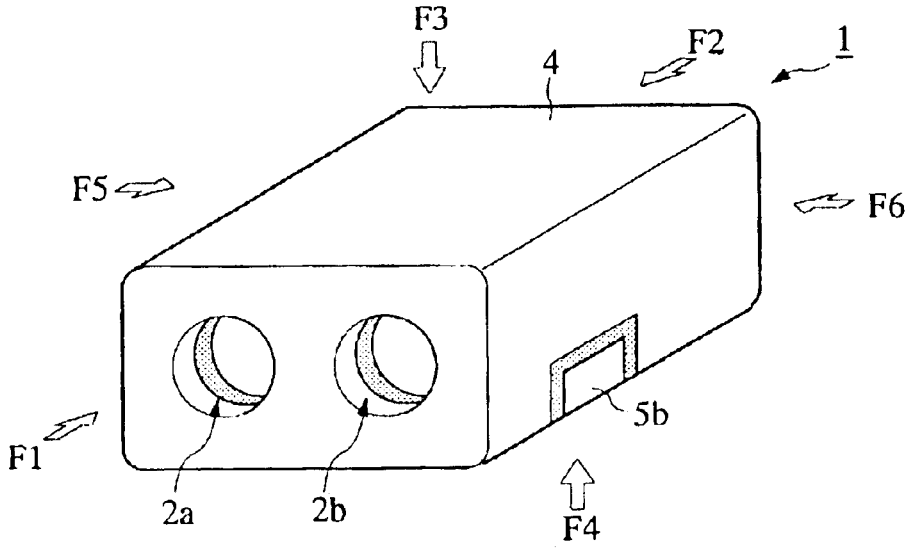
FIG. 5A is an external perspective view of a dielectric filter according to a second embodiment of the present invention.
Figure 5B:
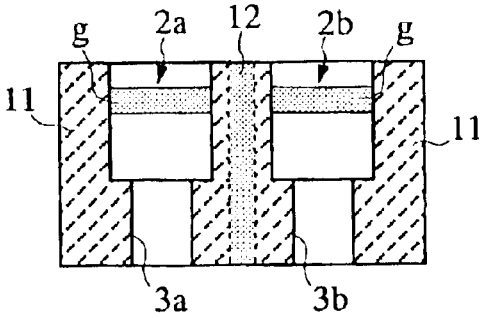
FIG. 5B is a cross-sectional view of the dielectric filter.
Figure 5C:
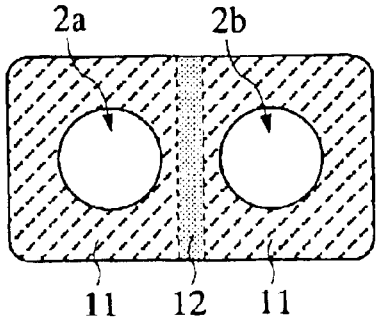
FIG. 5C is a longitudinal sectional view of the dielectric filter.

FIG. 5A is an external perspective view of the dielectric filter, FIG. 5B is a cross-sectional view of the dielectric filter, and FIG. 5C is a longitudinal sectional view of the dielectric filter. The dielectric filter according to the second embodiment is different from the dielectric filter according to the first embodiment in that the inside diameter of the through holes 2*a* and 2*b* at the first surface F1 side of the dielectric block 1 (open end side) differs from the inside diameter of those at the second surface F2 side (short-circuit end side), that is, the through holes 2*a* and 2*b* are stepped. This arrangement of the inner conductors 3*a* and 3*b* provided on the stepped through holes 2*a* and 2*b* increases the capacitive coupling of the two resonators near the open end side, thus allowing the capacitive coupling between the entire two resonators.

Figure 6:
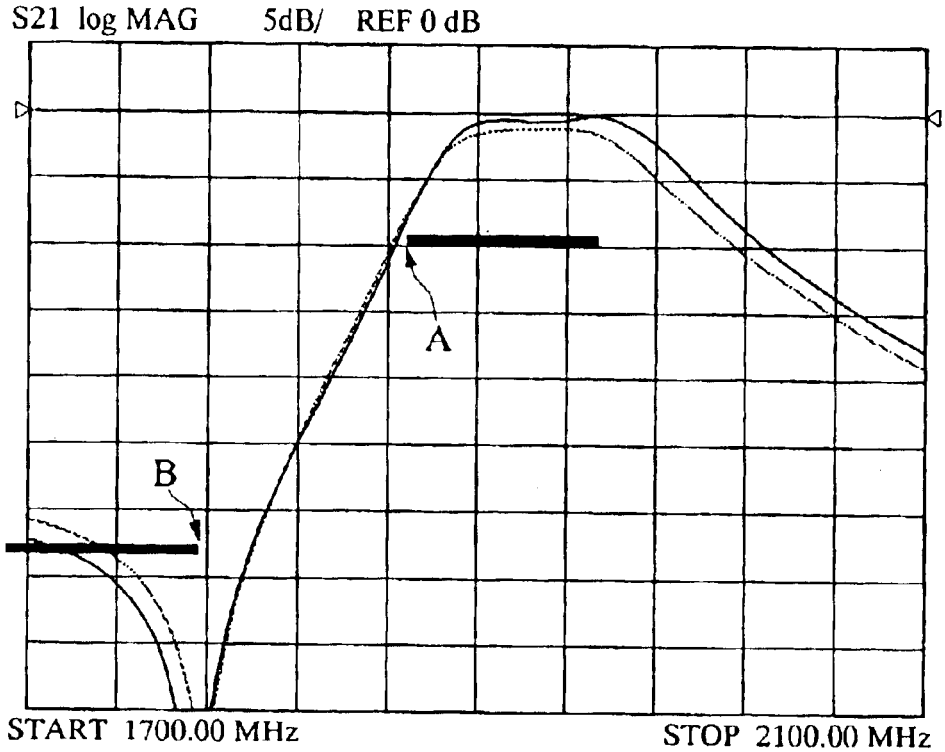
FIG. 6 is a graph showing the transmission characteristics of the dielectric filter.

FIG. 6 shows the transmission characteristics of the dielectric filter shown in FIGS. 5A to 5C. The capacitive coupling between the adjacent resonators generates an attenuation pole at a lower frequency than the pass band, as shown in FIG. 6.

The relationship of the temperature coefficient of the resonant frequency between the first dielectric 11 and the second dielectric 12 shown in FIGS. 5A to 5C is opposite to the relationship of the temperature coefficient of the resonant frequency between the first dielectric 11 and the second dielectric 12 shown in FIGS. 1A to 1C. More specifically, in the dielectric filter shown in FIGS. 5A to 5C, the temperature coefficient of the resonant frequency of the first dielectric 11 is a predetermined negative value, and the temperature coefficient of the resonant frequency of the second dielectric 12 is a predetermined positive value. Thus, although, at the high temperature, the insertion loss in the pass band increases due to the conducting loss of the inner conductors and the outer conductor, the pass band is shifted toward lower frequencies and the attenuation pole is shifted toward higher frequencies. Consequently, even at a high temperature, the insertion loss in the pass band is not above the value at the critical point in the pass band and the attenuation in the attenuation band is not below the value at the critical point in the attenuation band.

A dielectric filter according to a third embodiment of the present invention will now be described with reference to FIGS. 7A, 7B, and 7C.

Figure 7A:
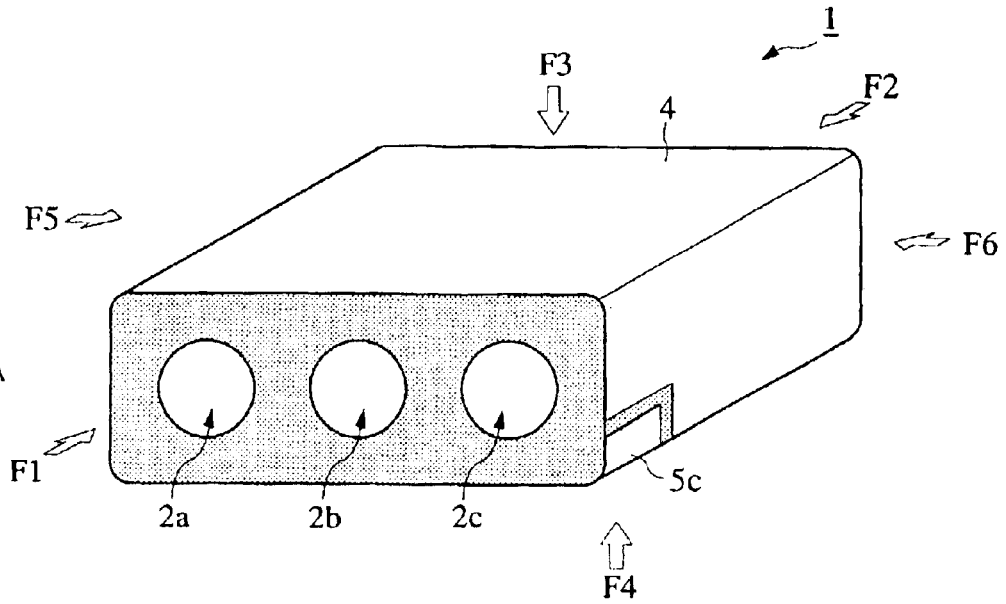
FIG. 7A is an external perspective view of a dielectric filter according to a third embodiment of the present invention.
Figure 7B:
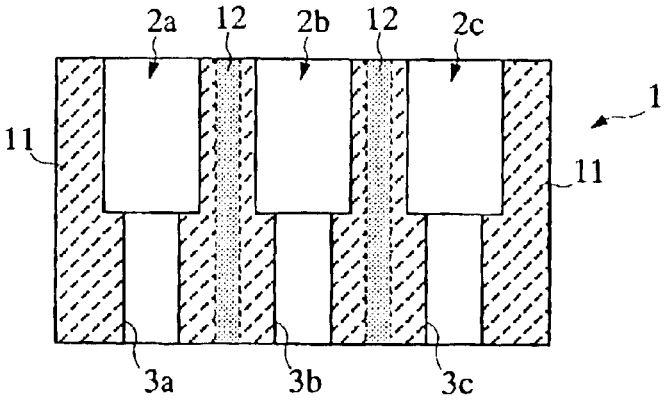
FIG. 7B is a cross-sectional view of the dielectric filter.
Figure 7C:
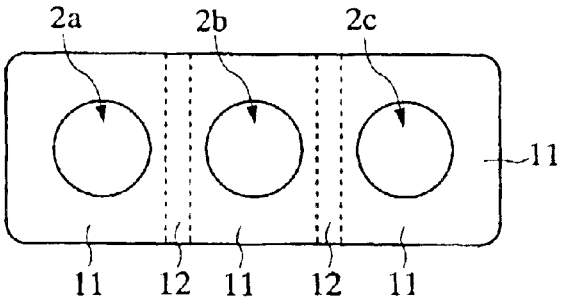
FIG. 7C is a longitudinal sectional view of the dielectric filter.

FIG. 7A is an external perspective view of the dielectric filter, FIG. 7B is a cross-sectional view of the dielectric filter, and FIG. 7C is a longitudinal sectional view of the dielectric filter. The dielectric block 1 is preferably a substantially rectangular parallelepiped. The dielectric block 1 has through holes 2*a*, 2*b*, and 2*c* that extend from the first surface F1 to the opposing second surface F2 and that are parallel to the third surface F3 and the opposing fourth surface F4 that are perpendicular to the first surface F1 and the second surface F2. Inner conductors 3*a*, 3*b*, and 3*c* are provided on the entire inner surfaces of the through holes 2*a*, 2*b*, and 2*c*, respectively. The outer conductor 4 is provided over five outer surfaces, other than the first surface F1, of the dielectric block 1. Thus, the first surface F1 is the open end of the inner conductors 3*a*, 3*b*, and 3*c*. An input-output electrode 5*c* is provided on a portion from the fourth surface F4 to the sixth surface F6 of the dielectric block 1, thus causing the capacitance between the input-output electrode 5*c* and the vicinity of the open end of the inner conductor 3*c*. Another input-output electrode (not shown) is provided on a portion from the fourth surface F4 to the fifth surface F5 of the dielectric block 1, thus causing the capacitance between the input-output electrode and the vicinity of the open end of the inner conductor 3*a*.

Accordingly, the capacitive coupling between the adjacent resonators causes an attenuation pole at a lower frequency than the pass band, as in the transmission characteristics shown in FIG. 6.

In a dielectric filter provided with more than two resonators, setting the temperature coefficient of the resonant frequency of dielectrics between resonators to positive and setting the temperature coefficient of the resonant frequency of the other dielectrics to negative allow excellent frequency characteristics in both the pass band and the attenuation band even at a high temperature.

Also, in a dielectric filter in which an electrode for capacitively coupling adjacent resonators is provided on an open surface such as the first surface F1 shown in FIG. 7, which is not being provided with the outer conductor 4, excellent frequency characteristics can be realized in both the pass band and the attenuation band even at a high temperature by setting the temperature coefficient of the resonant frequency of dielectrics between resonators to positive and setting the temperature coefficient of the resonant frequency of the other dielectrics to negative.

Figure 8A:
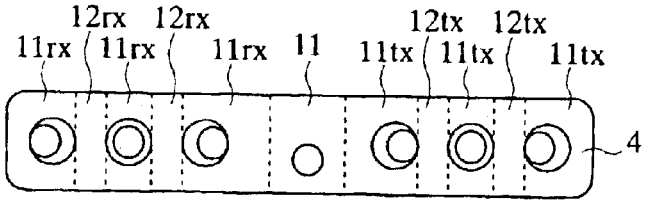
FIG. 8A is a front view of a dielectric duplexer according to a fourth embodiment of the present invention.
Figure 8B:
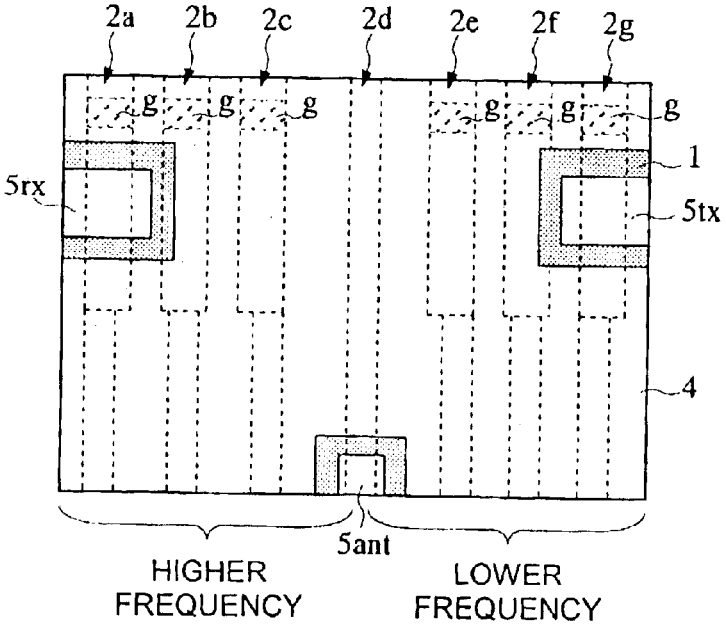
FIG. 8B is a bottom view of the dielectric duplexer.
Figure 8D:
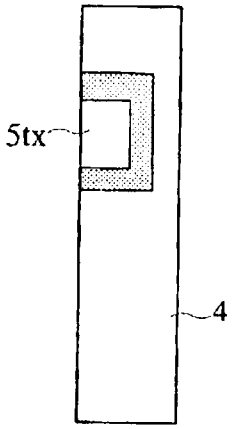
FIG. 8D is a right side view of the dielectric duplexer.
Figure 8C:
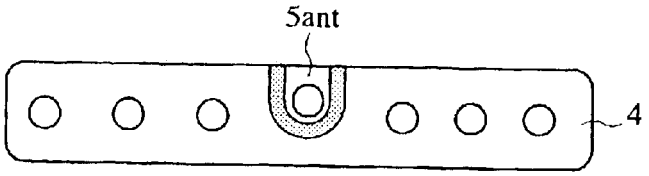
FIG. 8C is a back view of the dielectric duplexer.

A dielectric duplexer according to a fourth embodiment of the present invention will now be described with reference to FIGS. 8A, 8B, 8C, and 8D and FIG. 9. FIG. 8A is a front view of the dielectric duplexer, FIG. 8B is a bottom view of the dielectric duplexer, FIG. 8C is a back view of the dielectric duplexer, and FIG. 8D is a right side view of the dielectric duplexer. The dielectric block 1, preferably being substantially rectangular parallelepiped, has through holes 2*a*, 2*b*, 2*c*, 2*d*, 2*e*, 2*f*, and 2*g*. The through holes 2*a* to 2*g* extend from a first surface (shown in FIG. 8A) to a second surface (shown in FIG. 8C). Inner conductors are provided on inner surfaces of the through holes 2*a* to 2*g*. A nonconductive portion g, in which an inner conductor is not provided, is arranged at each of these inner conductors provided on the through holes 2*a* to 2*c* and 2e to 2*g*, thus causing the inner conductors to be opened and a stray capacitance to be generated between these inner conductors and the outer conductor. Input-output electrodes 5*rx* and 5*tx* are provided on outer surfaces of the dielectric block 1, thus causing a capacitance between the input-output electrodes and the inner conductors provided on the inner surface of the through holes 2*a* and 2*g*, respectively. Also, an input-output electrode 5*ant* for electrically connecting to the inner conductor provided on the inner surface of the through hole 2*d* is provided.

With the arrangement described above, a portion in which the through holes 2*a* to 2*c* are provided functions as a receive filter formed by three resonators that are capacitively coupled. A portion in which the through holes 2*e* to 2*g* are provided functions as a transmit filter formed by three resonators that are inductively coupled.

The through hole 2*d* operates as a hole for antenna excitation. Thus, the input-output electrodes 5*tx*, 5*ant*, and 5*rx* are used as an input terminal for a transmission signal, an antenna terminal, and an output terminal for a reception signal, respectively.

Referring to FIG. 8A, the transmit filter includes a first dielectric 11*tx* and a second dielectric 12*tx*. The receive filter includes a first dielectric 11*rx* and a second dielectric 12*rx*. The through hole 2*d*, functioning as an excitation hole, is surrounded by a first dielectric 11. Since the transmit filter exhibits an attenuation pole at a higher frequency than the pass band, the temperature coefficient of the resonant frequency of the first dielectric 11*tx* is set to a predetermined positive value, and the temperature coefficient of the resonant frequency of the second dielectric 12*tx* is set to a predetermined negative value. In contrast, since the receive filter exhibits an attenuation pole at a lower frequency than the pass band, the temperature coefficient of the resonant frequency of the first dielectric 11*rx* is set to a predetermined negative value, and the temperature coefficient of the resonant frequency of the second dielectric 12*rx* is set to a predetermined positive value. Thus, in both the transmit filter and the receive filter, an increase in the insertion loss near the critical point in the pass band and a decrease in the attenuation near the critical point in the attenuation band can be suppressed at a high temperature.

The temperature coefficient of the resonant frequency of the first dielectric 11 surrounding the through hole 2*d*, functioning as an excitation hole, is set to any value, since the temperature coefficient of the resonant frequency of the first dielectric 11 does not directly affect the frequency characteristics of the transmit filter and the receive filter. For example, if dielectrics are made of two kinds of materials, the first dielectric 11*tx* and the second dielectric 12*rx* are formed by the same materials having a positive temperature coefficient of the resonant frequency, and the second dielectric 12*tx* and the first dielectric 11*rx* are formed by the same materials having a negative temperature coefficient of the resonant frequency. In this case, the first dielectric 11 may be formed by the same materials as the first dielectric 1*tx*, and the consecutive area including the through holes 2*d* and 2*e* may be formed by the same materials. Alternatively, the first dielectric 11 may be formed by the same material as the first dielectric 11*rx*, and the consecutive area including the through holes 2*c* and 2*d* may be formed by the same materials.

Figure 9:
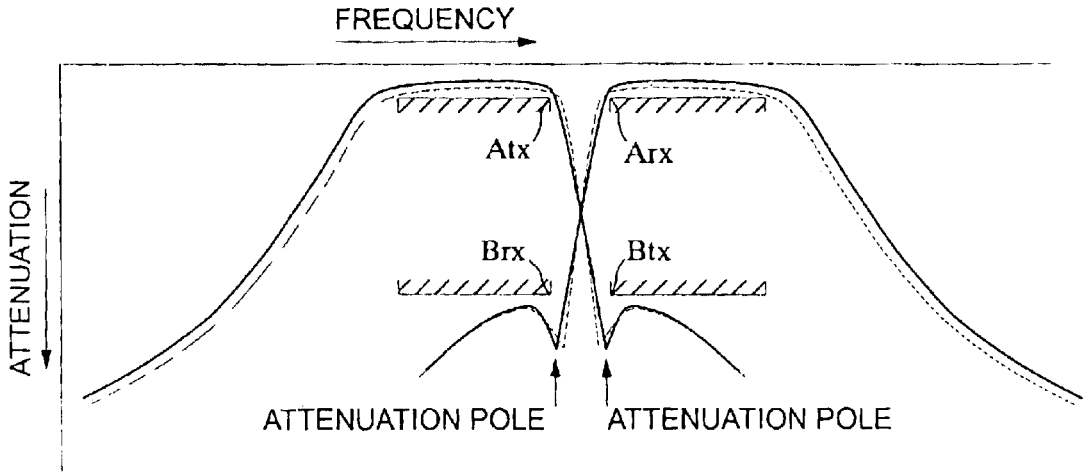
FIG. 9 is a graph showing the transmission characteristics of the dielectric duplexer.

FIG. 9 shows the transmission characteristics of the dielectric duplexer shown in FIGS. 8A to 8D. The transmission characteristics of the transmit filter exhibit an attenuation pole at a higher frequency, and the transmission characteristics of the receive filter exhibit an attenuation pole at a lower frequency. In FIG. 9, Atx and Arx represent critical points in the pass band, and Brx and Btx represent critical points in the attenuation band. Solid lines represent the transmission characteristics at room temperature, and broken lines represent the transmission characteristics at a high temperature. Although, at the high temperature, the insertion loss in the pass band increases due to the increase in the conducting loss of the inner conductors and the outer conductor, the increase in the insertion loss near the critical points Atx and Arx in the pass band and the decrease in the attenuation near the critical points Brx and Btx in the attenuation band can be suppressed at the high temperature in both the transmit filter and the receive filter. Thus, the insertion loss in the pass band does not exceed a predetermined value, and a predetermined attenuation is assured in the attenuation band.

Although stepped through holes are provided in the filter portions for capacitively coupling adjacent resonators in the example shown in FIGS. 8A to 8D, non-stepped through holes as shown in FIGS. 1A to 1C may be provided. An open surface as shown in FIGS. 7A to 7C may be provided in order to capacitively couple adjacent resonators. An electrode may be provided on the open surface in order to capacitively couple the adjacent resonators.

Although the inner conductors 3*a* and 3*b* are provided on the stepped through holes 2*a* and 2*b* in the second, third, and fourth embodiments, each central axis of the through holes 2*a* and 2*b* may be deflected, instead of making the inside diameter of the through holes 2*a* and 2*b* at the open end side different from that at the short-circuit end side, in order to determine the coupling between resonators.

Also, a hole or slot for coupling may be provided between through holes which function as resonator holes in order to determine the coupling between resonators.

A communication apparatus according to a fifth embodiment of the present invention will now be described with reference to FIG. 10.

Figure 10:
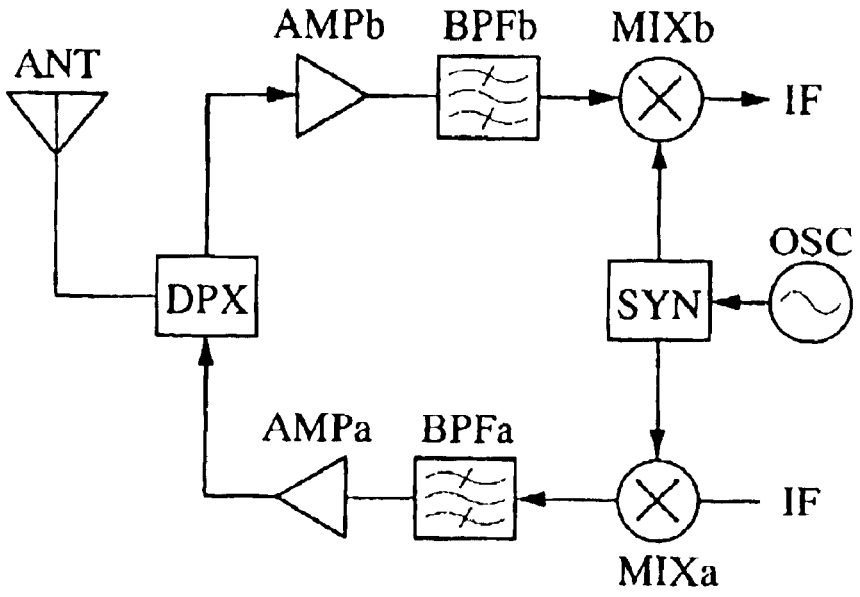
FIG. 10 is a block diagram showing the structure of a communication apparatus according to a fifth embodiment of the present invention.
Figure 11:
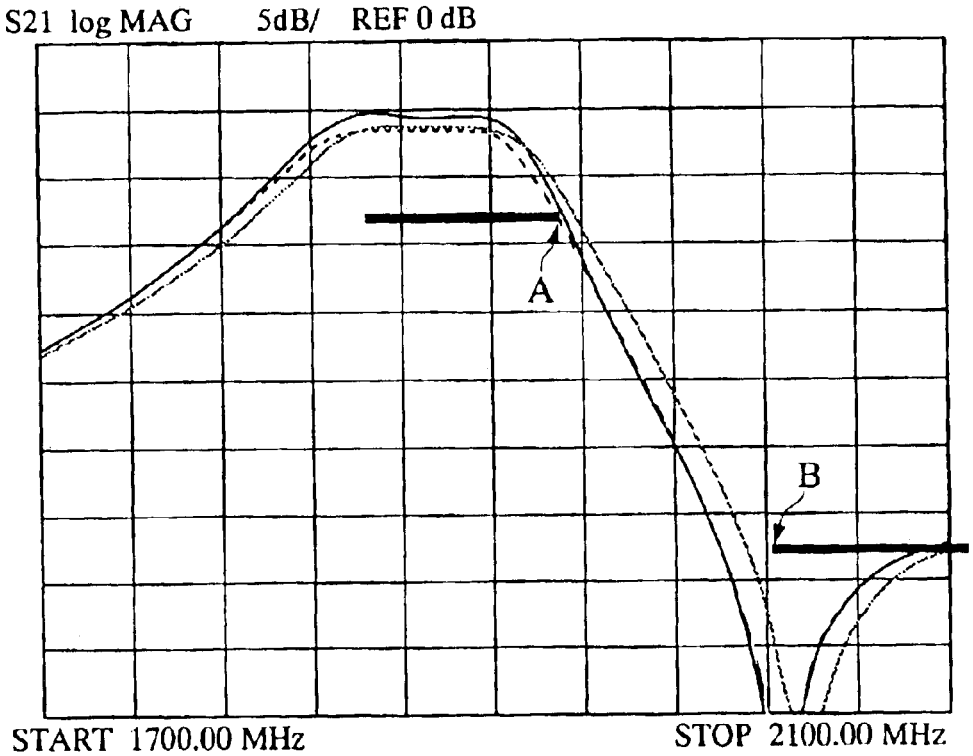
FIG. 11 is a graph showing the transmission characteristics of a known dielectric filter.

Referring to FIG. 10, ANT represents a transmitting and receiving antenna and DPX represents a duplexer. BPFa and BPFb represent band pass filters, AMPa and AMPb represent amplifying circuits, and MIXa and MIXb represent mixers. OSC represents an oscillator and SYN represents a frequency synthesizer.

The mixer MIXa mixes intermediate frequency signals IF and signals output from the frequency synthesizer SYN. The band pass filter BPFa passes only signals within a transmitting frequency range among the mixed signals output from the mixer MIXa. Then, the amplifying circuits AMPa power-amplifies the signals to be transmitted from the antenna ANT via the duplexer DPX. The amplifying circuit AMPb amplifies the signals received from the duplexer DPX. The band pass filter BPFb passes only signals within a receiving frequency range among the reception signals output from the amplifying circuit AMPb. The mixer MIXb mixes the frequency signals output from the frequency synthesizer SYN and the reception signals output from the BPFb to output an intermediate frequency signal IF.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein a stray capacitance is generated between at least one end of each of the inner conductors and the outer conductor so that resonators formed by the adjacent inner conductors are inductively coupled, and wherein the temperature coefficient of the resonant frequency of the first dielectric is positive and the temperature coefficient of the resonant frequency of the second dielectric is negative.

2. The dielectric filter according to claim 1, wherein the first dielectric is a composition of $MgTiO_3$ and $CaTiO_3$.

3. The dielectric filter according to claim 1, wherein the temperature coefficient of the resonant frequency of the first dielectric is 20 ppm/° C.

4. The dielectric filter according to claim 1, wherein the second dielectric is a composition of $MgTiO_3$ and $CaTiO_3$.

5. The dielectric filter according to claim 1, wherein the temperature coefficient of the resonant frequency of the second dielectric is −40 ppm/° C.

6. The dielectric filter according to claim 1, wherein the second dielectric covers a width of the dielectric block.

7. A dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein at least one end of each of the inner conductors is nor connected to the outer conductor so that resonators formed by the adjacent inner conductors are capacitively coupled, and wherein the temperature coefficient of the resonant frequency of the first dielectric is negative and the temperature coefficient of the resonant frequency of the second dielectric is positive.

8. The dielectric filter according to claim 7, wherein the first dielectric is a composition of $MgTiO_3$ and $CaTiO_3$.

9. The dielectric filter according to claim 7, wherein the second dielectric is a composition of $MgTiO_3$ and $CaTiO_3$.

10. The dielectric filter according to claim 7, wherein the second dielectric covers a width of the dielectric block.

11. A dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein a temperature coefficient of a resonant frequency of the first dielectric is different from a temperature coefficient of a resonant frequency of the second dielectric, the first dielectric is a composition of $MgTiO_3$ and $CaTiO_3$, and a ratio of $MgTiO_3$ to $CaTiO_3$ is 92 to 8.

12. A dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein a temperature coefficient of a resonant frequency of the first dielectric is different from a temperature coefficient of a resonant frequency of the second dielectric, the second dielectric is a composition of $MgTiO_3$ and $CaTiO_3$, and a ratio of $MgTiO_3$ to $CaTiO_3$ is 98 to 2.

13. A dielectric duplexer comprising:

a dielectric block, the dielectric block having at least a first plurality of through holes that extend from a first surface to an opposing second surface of the dielectric block to form a first dielectric filter, and a second plurality of through holes that extend from a first surface to an opposing second surface of the dielectric block to form a second dielectric filter;

an outer conductor provided on an outer surface of the dielectric block;

inner conductors provided on inner surfaces of the first and second plurality of through holes;

a first dielectric provided between the respective inner conductors and the outer conductor of the first plurality of through holes;

at least one second dielectric provided between the inner conductors of two adjacent through holes of the first plurality of through holes, a third dielectric provided between the respective inner conductors and the outer conductor of the second plurality of through holes;

at least one fourth dielectric provided between the inner conductors of two adjacent through holes of the second plurality of through holes, wherein a temperature coefficient of a resonant frequency of the first dielectric is different from a temperature coefficient of a resonant frequency of the second dielectric, wherein a temperature coefficient of a resonant frequency of the third dielectric is different from a temperature coefficient of a resonant frequency of the fourth dielectric, wherein the first dielectric filter has a lower-frequency pass band than the second dielectric filter.

14. The dielectric duplexer according to claim 13, wherein the first dielectric filter has a stray capacitance generated between at least one end of each of the inner conductors and the outer conductor so that resonators formed by the adjacent inner conductors are inductively coupled, and wherein the temperature coefficient of the resonant frequency of the first dielectric is positive and the temperature coefficient of the resonant frequency of the second dielectric is negative.

15. The dielectric duplexer according to claim 14, wherein at least one end of each of the inner conductors of the second filter is not connected to the outer conductor so that resonators formed by the adjacent inner conductors are capacitively coupled, and wherein the temperature coefficient of the resonant frequency of the third dielectric is negative and the temperature coefficient of the resonant frequency of the fourth dielectric is positive.

16. The dielectric duplexer according to claim 13, wherein at least one end of each of the inner conductors of the second filter is not connected to the outer conductor so that resonators formed by the adjacent inner conductors are capacitively coupled, and wherein the temperature coefficient of the resonant frequency of the third dielectric is negative and the temperature coefficient of the resonant frequency of the fourth dielectric is positive.

17. A communication apparatus comprising:

a dielectric filter, the dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein a stray capacitance is generated between at least one end of each of the inner conductors and the outer conductor so that resonators formed by the adjacent inner conductors are inductively coupled, and wherein the temperature coefficient of the resonant frequency of the first dielectric is positive and the temperature coefficient of the resonant frequency of the second dielectric is negative.

18. A communication apparatus comprising:

a dielectric duplexer, the dielectric duplexer comprising:

a dielectric block, the dielectric block having at least a first plurality of through holes that extend from a first surface to an opposing second surface of the dielectric block to form a first dielectric filter, and a second plurality of through holes that extend from a first surface to an opposing second surface of the dielectric block to form a second dielectric filter;

an outer conductor provided on an outer surface of the dielectric block;

inner conductors provided on inner surfaces of the first and second plurality of through holes;

a first dielectric provided between the respective inner conductors and the outer conductor of the first plurality of through holes;

at least one second dielectric provided between the inner conductors of two adjacent through holes of the first plurality of through holes, a third dielectric provided between the respective inner conductors and the outer conductor of the second plurality of through holes;

at least one fourth dielectric provided between the inner conductors of two adjacent through holes of the second plurality of through holes, wherein a temperature coefficient of a resonant frequency of the first dielectric is different from a temperature coefficient of a resonant frequency of the second dielectric, wherein a temperature coefficient of a resonant frequency of the third dielectric is different from a temperature coefficient of a resonant frequency of the fourth dielectric, and wherein the first dielectric filter has a lower-frequency pass band than the second dielectric filter.

19. A communication apparatus comprising:

a dielectric filter, the dielectric filter comprising:

a dielectric block, the dielectric block having a plurality of through holes that extend from a first surface to an opposing second surface of the dielectric block;

an outer conductor provided on an outer surface of the dielectric block;

inner conductors provided on inner surfaces of the plurality of through holes;

a first dielectric provided between the respective inner conductors and the outer conductor; and at least one second dielectric provided between the inner conductors of two adjacent through holes, wherein at least one end of each of the inner conductors is not connected to the outer conductor so that resonators formed by the adjacent inner conductors are capacitively coupled, and wherein the temperature coefficient of the resonant frequency of the first dielectric is negative and the temperature coefficient of the resonant frequency of the second dielectric is positive.

* * * * *